United States Patent [19]

Sugihara

[11] Patent Number: 4,610,289

[45] Date of Patent: Sep. 9, 1986

[54] SHUTTER

[75] Inventor: Toshihiko Sugihara, Mihara, Japan

[73] Assignee: Kyoritsu Kikai Company, Hiroshima, Japan

[21] Appl. No.: 637,402

[22] Filed: Aug. 3, 1984

[30] Foreign Application Priority Data

| | | | |
|---|---|---|---|
| Aug. 4, 1983 | [JP] | Japan | 58-143334 |
| Oct. 31, 1983 | [JP] | Japan | 58-205075 |
| Nov. 30, 1983 | [JP] | Japan | 58-227612 |
| Jan. 23, 1984 | [JP] | Japan | 59-010869 |

[51] Int. Cl.[4] ..... E06B 9/00

[52] U.S. Cl. ..... 160/35; 160/229 R; 49/192; 16/232; 16/DIG. 23

[58] Field of Search ..... 160/35, 32, 36, 229 R, 160/232, 236, 33; 16/231, 232, DIG. 23

[56] References Cited

U.S. PATENT DOCUMENTS

| | | | |
|---|---|---|---|
| 3,654,982 | 4/1972 | Labelle | 160/229 R X |
| 3,685,093 | 8/1972 | Sanders et al. | 16/231 |
| 3,989,084 | 11/1976 | Inamura et al. | 160/36 |
| 4,139,042 | 2/1979 | Watanabe et al. | 160/36 |
| 4,368,772 | 1/1983 | Bouthillier | 160/232 |
| 4,379,478 | 4/1983 | Lichy | 160/35 |

FOREIGN PATENT DOCUMENTS

| | | | |
|---|---|---|---|
| 224432 | 3/1959 | Australia | 160/36 |
| 2801786 | 7/1979 | Fed. Rep. of Germany | 160/35 |

*Primary Examiner*—Ramon S. Britts
*Assistant Examiner*—David M. Purol
*Attorney, Agent, or Firm*—Austin R. Miller

[57] ABSTRACT

The shutter is composed of a number of slats kept in parallel each other, and the slats are connected to each other with hinges so as to be folded in both forward and backward directions.

The hinges comprise the pins provided at the inside and outside corners of the butt end of one of the adjacent slats and extending in longitudinal direction of the slats, and the stoppers provided at the inside and outside corners of the butt end of the other slat and having the hinge holes which hold the said pins respectively so as to turn to the folded direction. Gaps are hardly made between adjacent slats because the turning axis of each hinge is at the inside and outside corners of each slat.

11 Claims, 24 Drawing Figures

SHUTTER

BACKGROUND OF THE INVENTION

This invention relates to a shutter which can be folded and housed on rails.

Sliding and wind-up methods have been available for housing folding and wind-up type shutters which are needed because of the small spaces that they require for housing.

Through the development of shutters provided with wide slats, a mechanism to fold each slat for housing was developed to take the place of noisy wind-up type housing mechanisms.

To design a housing mechanism of zigzag folding as mentioned above, the hinges connecting the slats must be folded in opposite directions.

Taking slat thickness into consideration, a set of link type hinges have been used for connection at both sides of the butt surface of the slats 1, so that the slats can be turned as is shown in FIG. 1.

Because of these hinges 4, the slats can be turned in forward direction as shown in FIG. 1 or in an opposite direction as shown in FIG. 2 when the shutter is housed. (Broken lines in these drawings show the rails.)

With this hinge mechanism, however, a large clearance 11 is created between the adjacent slats 1 when the slats turn as shown in FIGS. 1 and 2.

The gaps are also made by the weight of each slat itself when the shutter is lowered, causing difficulties such as allowing rain to come inside through the gaps, large noises as slats collide with each other, and the risk of fingers being caught between the slats. Another trouble is that the slats do not turn smoothly.

BRIEF SUMMARY OF THE INVENTION

The primary object of the present invention, is to provide a shutter free from such troubles as allowing rain to come inside through the gaps between slats, or the risk of fingers being caught by the slats and which allows the slats to be folded noiselessly and smoothly.

Other objects of the invention will become obvious from a reading of the description hereinafter disclosed while referring to the attached drawings.

DETAILED DESCRIPTION OF THE INVENTION

Figure 1:
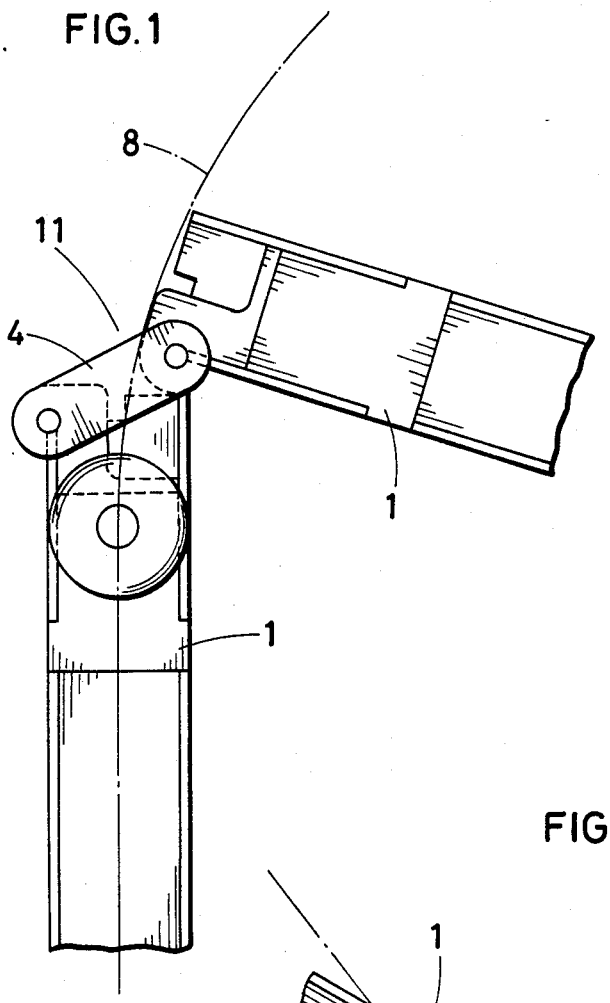
FIG. 1 and FIG. 2 are partial side views showing the turning condition of the slats connected to each other with hinges of a conventional type.
Figure 2:
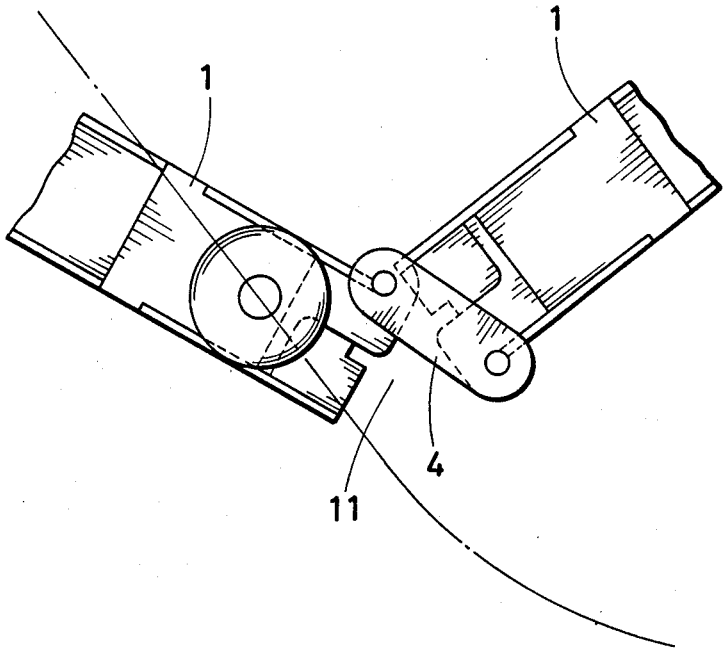
Figure 3:
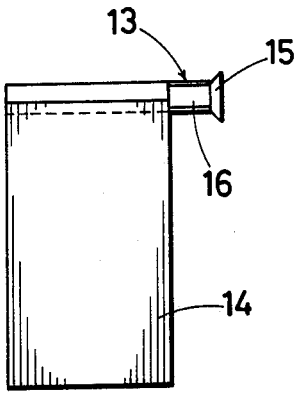
FIG. 3 and FIG. 4 are side and sectional views of the pin composing the hinge of an embodiment of the shutter of this invention.
Figure 4:
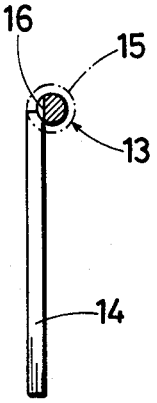

FIG. 3 and FIG. 4 show an example of the pin (13) as a component part of the shutter by this invention that is combined with the stopper which is described hereinafter to compose a hinge.

Figure 5:
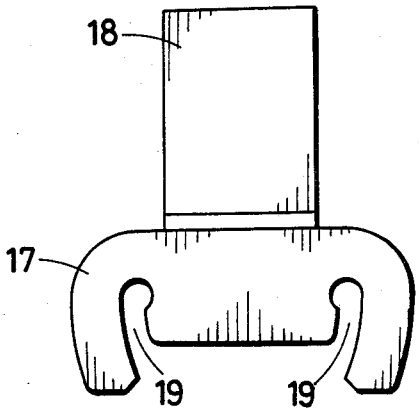
FIG. 5 is a front view of the stopper composing the hinge, together with the pin of FIG. 4.

As shown in these figures, the pin (13) is formed with the fitting plate (14) and extends from a side of the fitting plate (14), with the diameter being made larger at the head (15). Of the section projecting from the fitting plate (14), the whole section except the head (15) is subjected to chamfering forming the chamfered section (16). FIG. 5 shows the stopper (17) to hold the pin. Like the pin, the stopper (17) is fixed onto the fitting plate (18) and extends from a side of the fitting plate (18), but is bent in the middle.

From the opposite side of the stopper (17) to the fitting plate (18), groove type hinge holes 19 are provided, having an opening to receive the above mentioned pin from the side opposite to the fitting plate (18). The hinge holes 19 are slightly hooked-shaped so as to hold the pins on the inside.

Figure 6A:
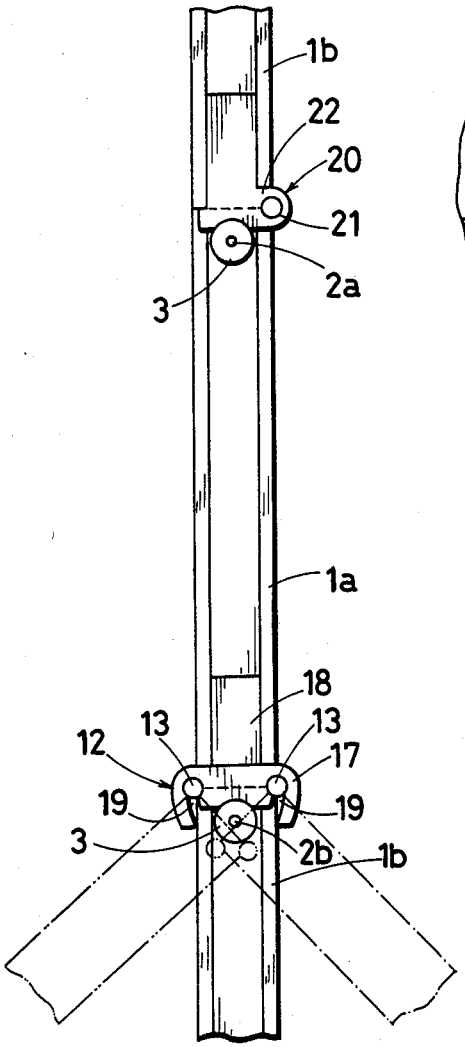
FIGS. 6(*a*) and 6(*b*) are side and partial front views of the slat in an embodiment of the shutter of this invention.
Figure 6B:
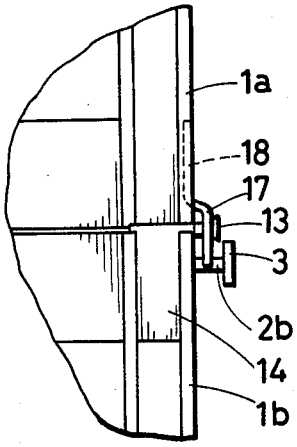

In FIGS. 6(*a*) and 6(*b*), the above pins 13 and the stopper 17 are respectively attached near the inside and outside corner at both sides of the butted end of the slats (1*a*), (1*b*) of which fitting plates (14) (18) are adjacent each other, and are connected to each other. At both sides of the butt end of one slat (1*a*), two hinge holes (19, 19) of the stopper (17) are positioned at inner and outer edges of the butt end with the openings facing to the adjacent slat (1*b*). At the inner and outer edges of the butt end of the other slat (1*b*) adjacent to the slat (1*a*), two pins (13, 13) extend outward along the longitudinal direction of the slat and in a symmetrical arrangement so as to be interlocked respectively with the inside of the above mentioned hinge holes (19,19).

As described above, the pins (13,13) of hinge (12) are held by the inside of the hinge holes (19,19) of the said stopper (17) so that they can be released.

As shown by the alternate long and short dash lines and the alternate long and two short dashes lines in FIG. 6(*a*), the hinge (12) is composed such that slats 1*a* or 1*b* turn around the pin (13) held in the hinge hole (19) at one side of the stopper (17), while the other pin (13) not at the center of the turning, is pulled out of the holding hinge hole (19), which makes the turning of the slat (1*a*) possible.

Accordingly, the hinge (12) can be turned in both forward and backward directions.

The roller (3) under the hinge (12) (at the top end of the slat (1*b*) is attached to the top end of a short shaft (2*b*) and drops to the lower guide (7*b*) (shown in FIG. 8) through the notch (not illustrated) as described later.

In addition, another hinge (20) is attached to the joint next to the joint between 1*a* and 1*b* to which the said hinge (12) is attached as shown in FIG. 6(*a*). The hinge (20) is an ordinary type and is made up of the pin (21) extending from one edge of the slat (1*a*) in the longitudinal direction of the slat, and the pin holder (22) attached to the other slat (1*b*), and can turn about 180° between the slats (1*b*, 1*a*) around the pin (21) fixed to the pin holder (22). The roller (3) under the hinge (20) (at the top end of the slat 1*a*) is attached to a long shaft (2*a*) and is directed toward the horizontal guide (shown in FIG. 5) as described later.

Figure 7:
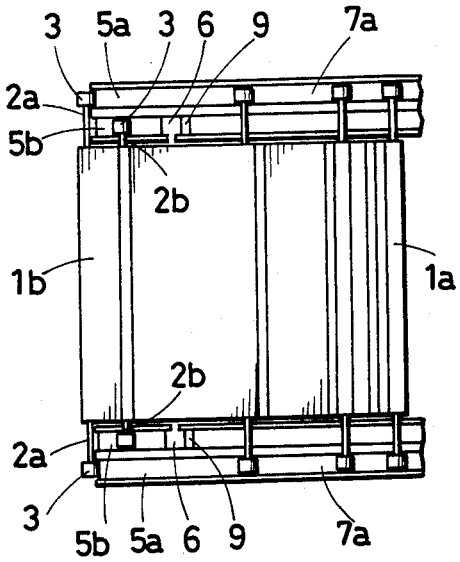
FIG. 7 is a partial top view of an embodiment of the shutter of this invention.
Figure 8:
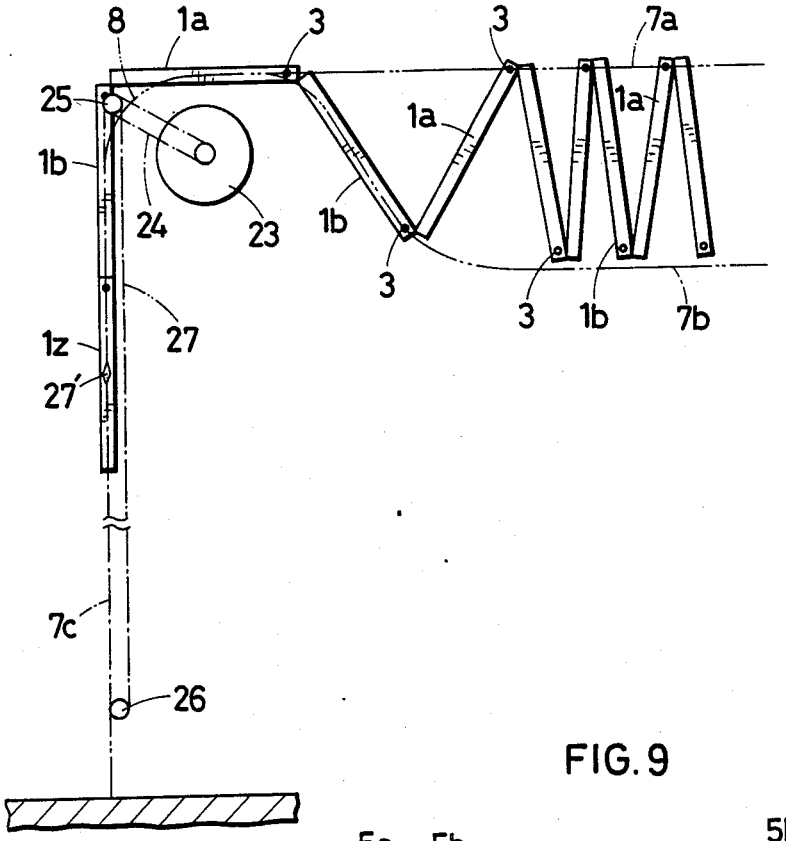
FIGS. 8 through 10 are respectively, a side view, a partial front view, and a partial enlarged side view for schematic expression of the shutter of FIG. 7.

FIG. 7 and FIG. 8 show the housing mechanism in the above embodiment. As indicated in these drawings, a large number of slats (1*a*, 1*b*) are kept parallel to each other, and each slat (1*a*, 1*b*) is provided with a roller support shaft at both ends. The support shafts, however, are in two different lengths, one (2*a*) is long, the other is short, and are attached alternately to each adjacent slat. A roller (3) is attached to the end of each support shaft (2*a*, 2*b*). The slats are connected to each other by a hinge (not illustrated) so as to be folded.

Figure 9:
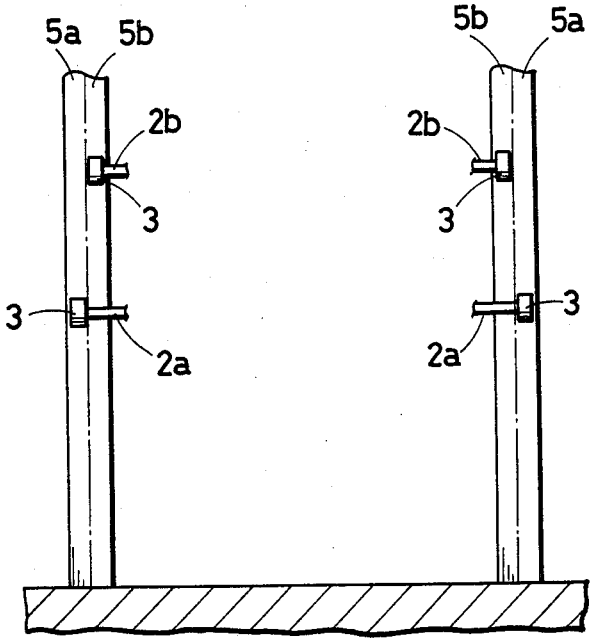

As shown in FIG. 9, two grooved rails (5*a*, 5*b*) are placed in parallel and facing to the front at both sides of the slats 1*a*, 1*b*, to guide up-down motion of the slats. This arrangement enables the reduction of the thickness of the slats without increasing the number of parts, and further allows the appearance of the rails to be improved.

Figure 10:
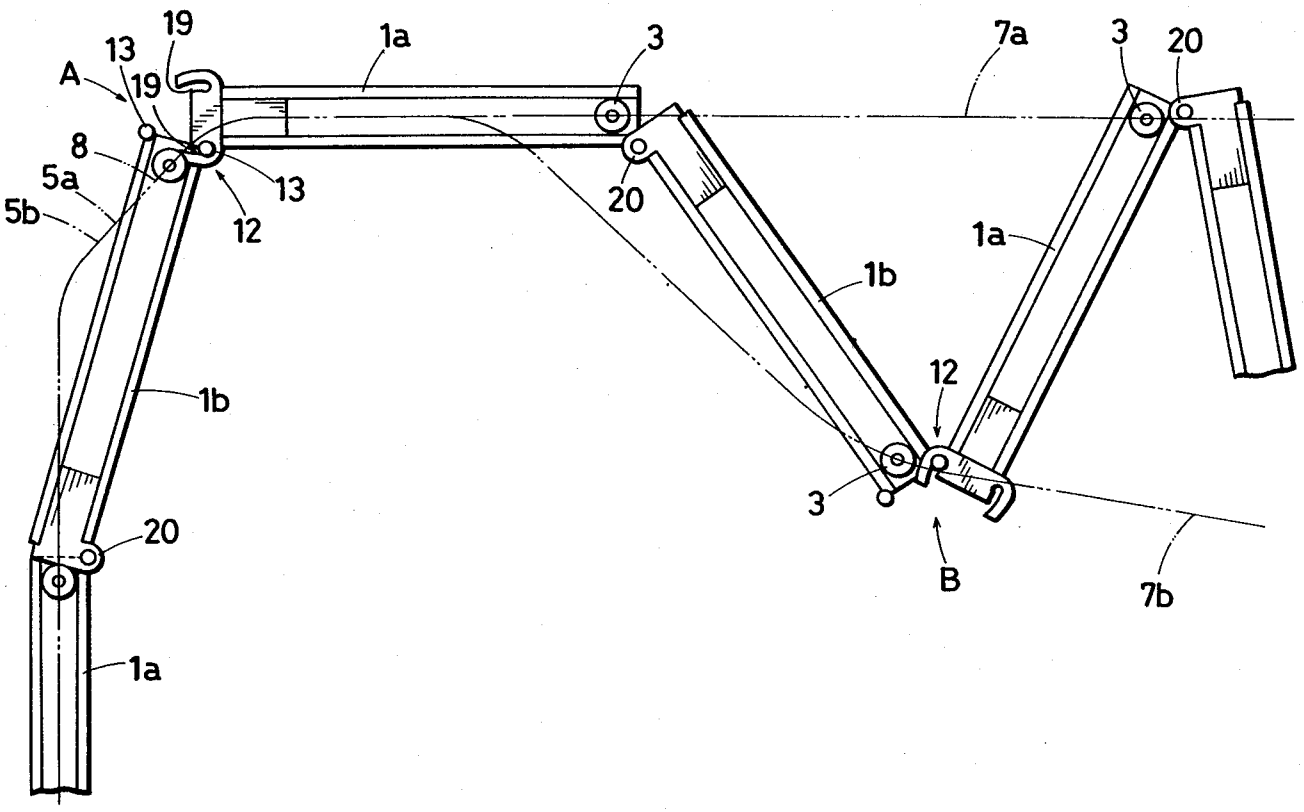

On one rail (5*a*), the roller (3) of the longer support shaft (2*a*) rolls, and on the other rail (5*b*), the roller (3) of the shorter support shaft (2*b*) rolls. One rail (5*a* ) goes up vertically and turns to the horizontal guide (7*a*) after drawing an arc as shown in FIG. 10. While the other rail (5*b*) goes up along the rail (5*a*) and is cut off by the notch (6) at the end of the arc, as shown in FIG. 7. Connected to the bottom of the notch (6) is a lower guide (7*b*) which is inclined once, and then is kept parallel to the horizontal guide (7*a*).

In FIG. 7, (9) is the guide for dropping of the roller into the notch (6).

When the shutter is housed, the roller (3) of the longer shaft (2*a*) goes toward the horizontal guide (7*a*) along the rail (5*a*), but the roller (3) of the shorter shaft (2*b*) drops from the notch (6) and goes toward the lower guide (7*b*).

Since the long and short shafts (2*a*, 2*b*) are provided alternately at the top end of the slats (1*a*, 1*b*), as described above, the slats (1*a*, 1*b*) are housed in zigzag from between the horizontal guide (7*a*) and the lower guide (7*b*).

For housing, rotation of the motor (23) is transmitted to the chain wheel (25) through the chain (24) as shown in FIG. 8, and the chain (27) set between the chain wheel (25) and the gear (26) fixed at a side of the bottom of the door is turned by the motor (23). The bottom slat (1*z*) which fixes the chain (27) to the stay (27′) is pulled up.

As illustrated in FIG. 10, the two kinds of hinges (12, 20) are attached alternately to each slat. If housing of the shutter is complete before the slat at the bottom of the shutter reaches the notch, the hinge at the bottom may be of the type which can turn in a forward direction only.

Of the two kinds of hinges (12, 20), the former is used between the slats going down to the lower guide (7*b*) as it can turn in both forward and backward directions, and the latter is used between the slats moving to the upper horizontal guide (7*a*) to which 180° turning is sufficient.

The hinge (12) turns the butted slats (1*a*, 1*b*) in a foward direction, as shown by A in FIG. 10, at the arc (8) of the rail (5*b*) while taking one pin (13) at the turning axis (at this time, the other pin (13) is off the hinge hole (19)), then holds both pins (13, 13) once in the hinge holes (19, 19).

When the said slats (1*a*, 1*b*) slide downward to the lower guide (7*b*), the said pin (13) is pulled out of the hinge hole (19). The other pin (13) is held in the hinge hole (19), and the slats (1*a*, 1*b*) are turned in an opposite direction, as shown by B in FIG. 10, on the pin (13) at the turning axis.

The hinge (20) allows the slats to turn (1*b*, 1*a*) in a forward direction at the arc (8) of the rail (5*a*), then turn the slats (1*b*, 1*a*) again in a forward direction when the rear end of the slat (1*a*) comes down toward the lower guide (7*b*).

The slats (1*a* through 1*z*) are folded alternately in zigzag form and are housed.

In the above embodiment, the stopper is made of a solid sheet having a hinge hole respectively at the inner and outer edge of the slats.

However, the stopper may be of the type with one hinge hole to be provided separately at the inner and outer edge of the slats.

Figure 11:
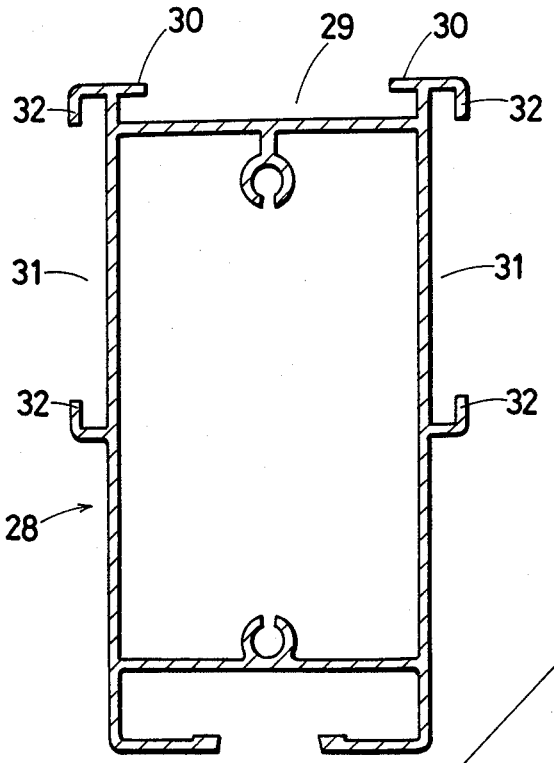
FIG. 11 is a sectional view of the frame used for the slat of FIG. 6.

The slats are usually made of a panel and a frame around the panel. The hinges composing the shutter of this invention are ordinarily attached to this frame member. If the frame member is so composed to facilitate hinge attachment, assembling of the shutter is simpler. For example, FIG. 11 shows that the slat side of the frame member (28) is made to a groove (29) having inward collars (30, 30), and the fitting plate of the stopper (shown in FIG. 5) can be inserted into the groove (29). The fitting plate is attached by screws as being fixed to the groove (2). The frame member (28) is also provided with the grooves (31) having the projections (32, 32) at both sides of the said groove (29). These grooves (31, 31) are respectively composed so as to accept the fitting plate of each pin (shown in FIG. 3.) The fitting plate is attached by screws.

Figure 12:
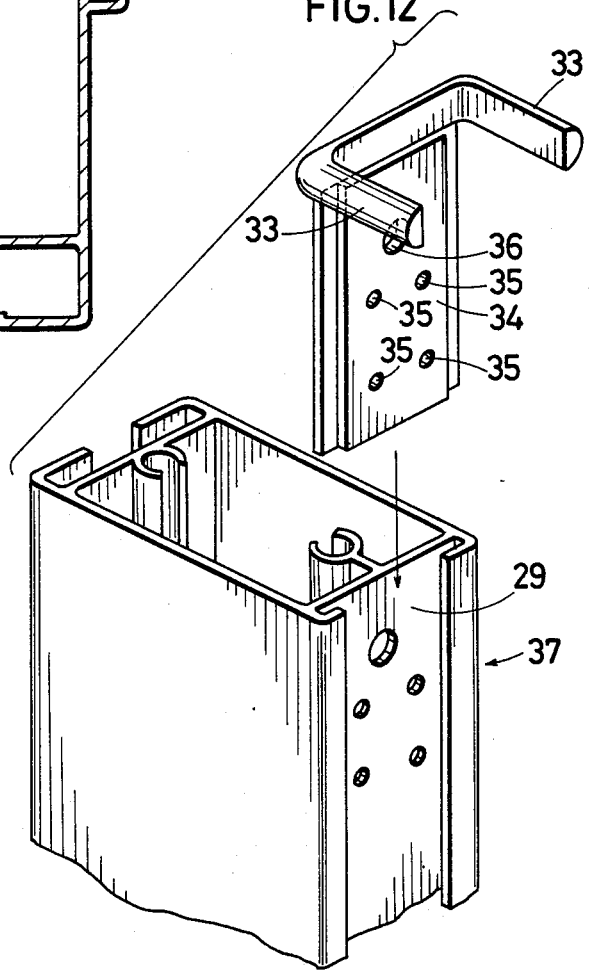
FIG. 12 is a partial oblique view of the pin and frame composing another embodiment of the shutter of this invention.

In the above embodiment, the pins which can turn in both forward and backward directions are provided respectively at the inner and outer corners of the slat so that each fitting plate can be attached at both sides of the slat. The arrangement, however, is not limited to this embodiment only. For example, the arrangement as shown in FIG. 12 is also possible, in which the pins (33, 33) are extended from the top and both sides of a sheet of fitting plate (34) in a direction perpendicular to the fitting plate (34). By using this, the number of parts can be decreased and the manufacturing time of the shutter can be shortened. To attach the pin (33, 33) made into a single part, a frame member (37) as shown in FIG. 12 may be used. This frame member (37) is provided only with the center groove (29) of the three grooves (29, 31, 31) shown in FIG. 11. The fitting plate (34) is inserted into the groove (29) of the frame member (37) as indicated by an arrow, then the fitting plate (34) is fixed with screws. Holes 35 are the screw holes and hole 36 is the hole through which the support shaft of the roller (36) goes.

As shown in FIG. 6*a*, the hinge (12) which can turn in both forward and backward directions in the said embodiment is stopped by the curved surface on the outside of the pin in contact with the outside of the hinge hole (19) of the stopper. If the curve of the outside surface of the hinge hole (19) is not sharp from the inside toward the opening, the curved surface of the pin outside slides down the outside surface of the hinge hole (19) when a pulling force is applied to the hinge (12) in either an up or down direction. Then the pin is pulled out of the inside of the hinge hole (19) slightly, and a gap may be made. This may disturb smooth turning of the hinge and may increase the gap between slats.

Figure 13:
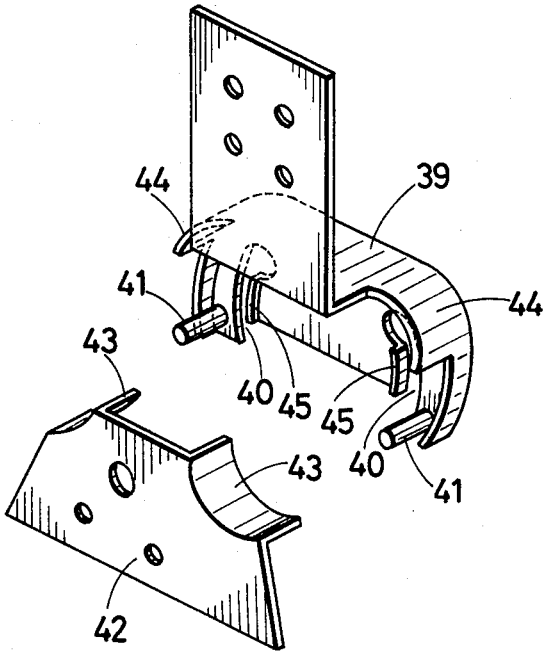
FIG. 13 is an oblique view of the stopper and fitting composing another embodiment of the shutter by this invention.

Accordingly, FIG. 13 shows that the support pins (41, 41) are provided at both sides of the back of the stopper near the opening of the hinge holes (40, 40) of the stopper (39). Moreover, a fitting piece (42) having an arc shaped projection (43, 43) at both sides so as to be supported by the said support pins (41, 41) is attached to the slat without the stopper (39) of the adjacent slats (not illustrated), facing the back side of the said stopper (39).

Figure 14:
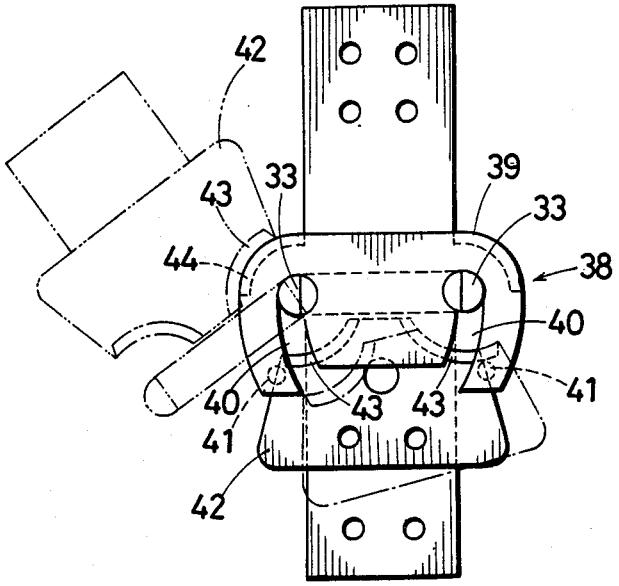
FIGS. 14 and 15 are respectively front and side views of the hinge mechanism in another embodiment of the shutter of this invention.

As illustrated in FIG. 14, the fitting piece (42) is positioned slightly to the inside of the support pins (41, 41) to the extent that the ends of the projections of the fitting piece (43, 43) come in slight contact with the support pins (41, 41) providing that only one of the pins (33) is pulled out. By this arrangement, the gap at the inside of the hinge holes (40, 40) can be prevented since the support pins (41, 41) of the stopper (39) on one slat are held by the outer ends of the projections (43, 43) of the other slat even when a pulling force to the hinge (38) comprising the said stopper (39) and the pins (33, 33) is applied in either an up or down direction.

As shown in FIG. 13, a wall (44, 44) is provided at the top of the both sides of stopper (39) in a manner to cover up the inside of the hinge hole (40, 40). With the hinge of the said embodiment, the pins at the center of the turning may release from the hinge hole because of the weight of the slat when the hinge makes a large turn around the other pin (B of FIG. 10). The walls (44, 44) shown in FIG. 13, however, prevent pin (33) at the center of turning from being released because one of the projection (43) of the fitting piece (42) attached to the pin side slat comes in contact with the walls when the pin side slat (omitted for simplification) makes a large turn as shown by the alternate long and two short dashes lines in FIG. 14. When the hinge (38) is turning, one of the projections (43) of the fitting piece (42) slides along the support pin (41) of the stopper (39) as shown by the alternate long and short dash line in FIG. 14.

As shown in FIG. 13, the inside of the hinge holes (40, 40) of the stopper is projected toward the back side (45, 45). The projections serve to increase the contact area to the pin (not illustrated) going in and out the hinge holes (40, 40) to guide the pin smoothly and to reduce wear due to sliding.

Figure 15:
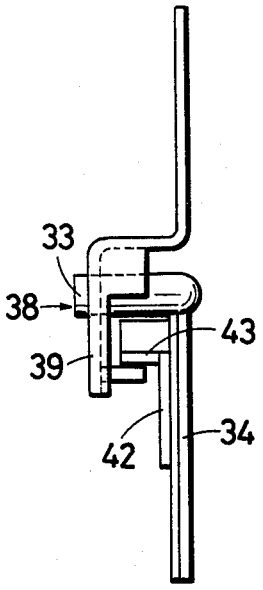

FIG. 15 is a side view of the mechanism of the hinge (38). The fitting piece (42) having arc shaped projections (43, 43) is provided between the fitting plate (34) of the pin (33, 33) and the stopper (39).

Figure 16:
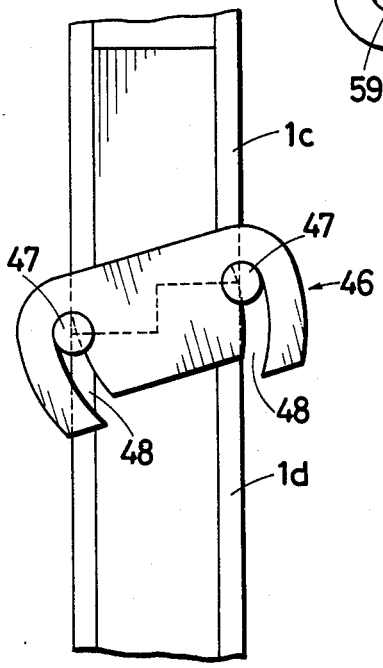
FIG. 16 is a partial front view showing still on other embodiment of the shutter of this invention.

The butt ends of the adjacent slats (1*c*, 1*d*) are notched as shown in FIG. 16, and the hinge (46) may be inclined by attaching the pins (47, 47) and the hinge holes (48, 48) at the inside and outside corners of each. This can also prevent the pin at the center of turning from releasing when the slat makes a large turn.

Figure 17:
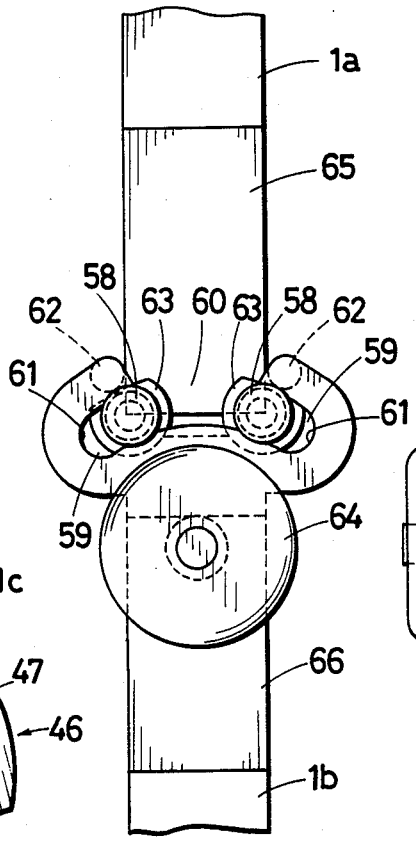
FIGS. 17 and 18 are respectively a partial side view and partial front view showing still another embodiment of the shutter of this invention.
Figure 18:
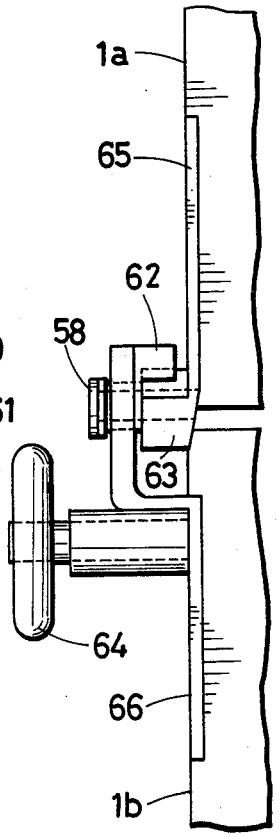

FIG. 17 and FIG. 18 show another embodiment of the shutter of this invention.

As shown in these drawings, the pins (58, 58) are provided at the inside and outside corners of the butted end of one slat (1*a*) projecting along the longitudinal direction of the slat (1*a*).

The top of the pins (58, 58) is formed into a roller. Accordingly, the movement is smooth. At the butt end of the other slat (1*b*), hinge holes (59, 59) of approximate arc shape and having an opening (60) at the center of the butt end are provided between the inside and outside corners of the slat butt end.

The width of the opening (60) of these hinge holes (59, 59) is a little shorter than the distance between the outside ends of the pins (58, 58). At the position where the two slats are aligned on a straight line as shown in FIG. 17, the two pins (58, 58) remain within the opening (60) and the two slats remain butted together.

The distance from the end of one hinge hole (59) to the inside of another hinge hole (59) at the opposite side is a little longer than the distance between the outside ends of the two pins (58, 58). When one of the pins (58) is at the inside of one hinge hole (59), therefore, the other pin (58) can go out of the opening (60) shown in FIG. 19 and the upper slat (1*a*) can turn clockwise or counterclockwise from the position shown in FIG. 17.

At the position close to the opening on the back of both sides of the hinge hole opening (60), inward projecting pins (62, 62) are provided.

At the root of each pin (58), a stopper (63) is provided, which does not hinder the motion of the pins (58, 58) when the pins move in the hinge hole (59) but comes in contact with the inward projected pin (62) to stop the motion of the other pin (58) acting as the turning axis at the inside of the hinge hole (59).

Each stopper (63) is chamfered at the section corresponding to each inward projecting pin (62) so that the hinges (58, 58) can move freely between both ends of the hinge hole (59).

The hinge composed in this manner is attached to the side of the slat by screwing (not illustrated) the fitting plate (65) having pins (58, 58), and also the fitting plate (66) having the hinge hole (59) respectively to the corresponding slat 1*a* or 1*b*. Wheel (64) is the roller provided at the top end of the short support shaft.

When the shutter is lowered, the slats are vertical and the hinges between the slats are symmetrically aligned as is shown in FIG. 17.

The slats are turned when the shutter is housed. The housing mechanism of this embodiment is approximately similar to the housing mechanism shown in FIG. 7 and FIG. 8.

Figure 19:
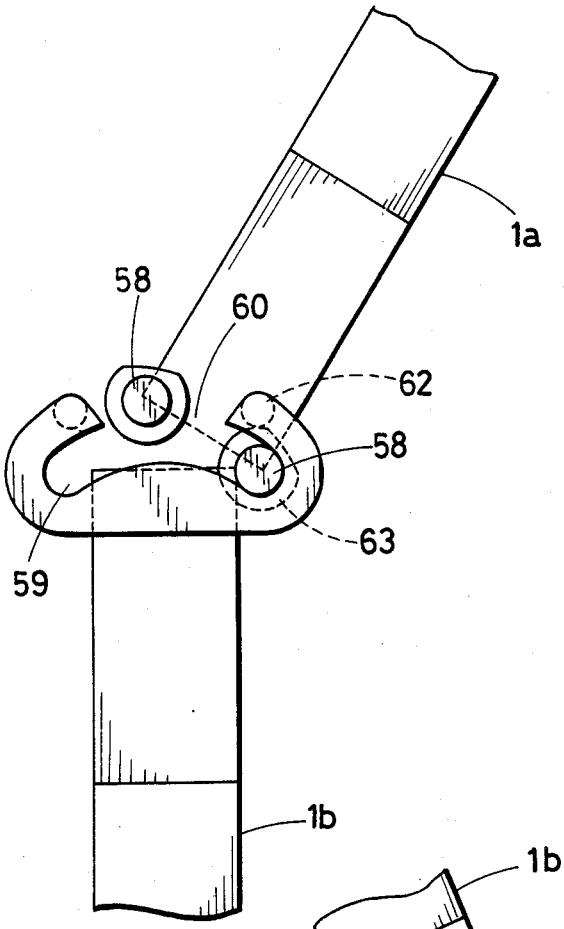
FIGS. 19 and 20 are respectively a partial side view showing operation of the shutter of FIG. 17.

As to the turning condition between the slats position at the right side of the shutter viewed facing to it, the upper slats (1*a*) turns toward the inside of the shutter in going through the arc of the rail (8 in FIG. 8) as illustrated in FIG. 19.

At this time, the pin (58) at the inside of the shutter out of the pins (58, 58) provided on the upper slat (1*a*) goes into the inside of the hinge hole (59) provided on the lower slat (1*b*) while sliding sideways. The pin (58) at the outside of the shutter follows the turning motion of the upper slat (1*a*) and goes out upward from the opening (60) of the hinge hole.

The pin (58) at the inside of the said shutter is positioned in a manner that can be turned by the function of the stopper (63) at the root and of the inward projecting pin (62) held by the stopper. When the slat turns, operation of the shutter is not hindered by a disengaged pin or any positional deflection.

After going through the arc of the said rail (8 in FIG. 8), the upper slat (1*a*) and the lower slat (1*b*) are turned to a horizontal position, and the pins (58, 58) at both sides are held in the hinge holes (59, 59) as shown in FIG. 17.

Under this condition, both of the pins (58, 58) are held firmly in the hinge holes (59, 59).

Figure 20:
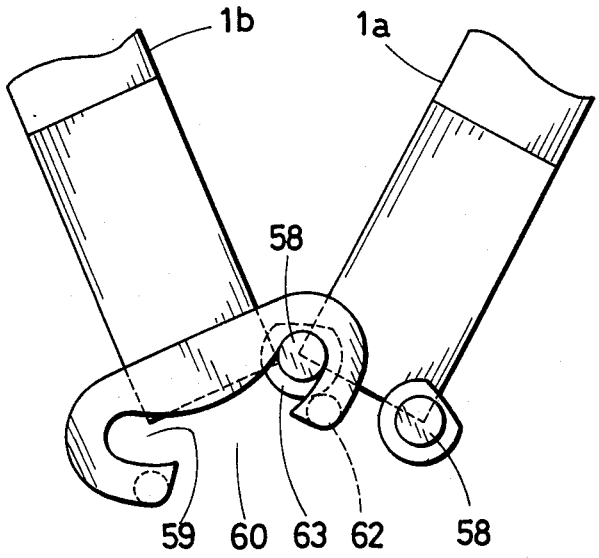

When the upper slat (1*a*) slides down to the lower guide (7*b* in an opposite FIG. 8), the upper slat (1*a*) turns in direction to the motion in the arc of the said rail as shown in FIG. 20.

Of the pins (58, 58) of the upper slat, the one (58) at the outside of the shutter slides sidewise into the inside of the other hinge hole of the lower slat (1*b*).

Since the pin (58) on the inside of the shutter follows the turning motion of the upper slat (1*a*), the pin goes out of the opening (60) of the hinge hole. The pin (58) at the outside of the said shutter is positioned in a manner to turn freely by the function of the stopper (63) at the root, and also of the inward projecting pin (62) held by the stopper. As in the case of turning at the arc of the said rail, there is no interference of operation between slats.

In the preferred embodiment, the pin is provided at the side of the upper slat and the hinge hole is at the side of the lower slat as shown in FIG. 19. The composition, however, may be reversed as shown in FIG. 20.

The hinge which can turn in both the forward and backward directions may be provided to all the slats.

It is possible however, to provide the hinges between the necessary slats only (to every other slat), and to provide the hinges which can turn in the forward direction only, to other slats.

Figure 21:
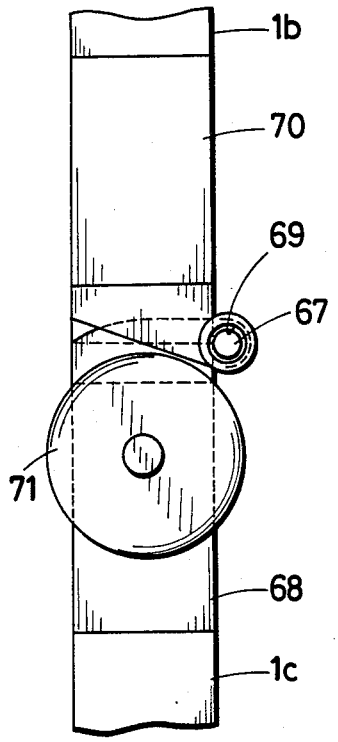
FIGS. 21 and 22 are respectively side and partial front views showing other slats of the shutter of FIG. 17.
Figure 22:
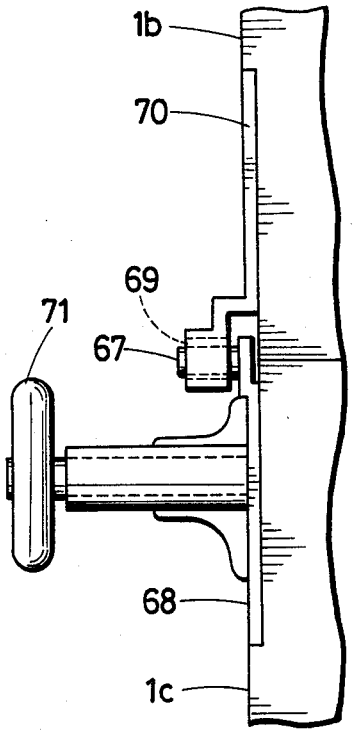

For example, the mechanism (67 and 69) between slats which turn in the forward direction only is shown in FIG. 21 and FIG. 22.

A fitting piece (68) having a projecting pin (67) positioned in the longitudinal direction of the slat at the inside corner of the butt end of the slat is provided at a side of the lower slat (1*c*).

At the side of the upper slat (1*b*), on the other hand, the fitting piece (70) in attached, which has the pin hole (69) to receive the said pin (67) at the inside corner on the slat butt end. Wheel (71) is the roller provided at the top of the long support shaft.

In the above embodiment, the hinge which can turn in both a forward and backward direction is provided with an inward projecting pin and the stopper, which do not prevent motion in such directions when the pin moves in the hinge hole but function to stop the pin at the inside of the hinge hole when the pin acts as the center axis of the turning motion.

The mechanism for these functions, however, is not limited to this embodiment.

It is possible, for example, to enlarge the diameter at both sides of the hinge hole slightly toward the upper side, so as to support the pin at the center of the turning motion.

The hinge in the above embodiment is so composed as to be attached to the frame member (25) shown, for example, in FIG. 11.

Figure 23:
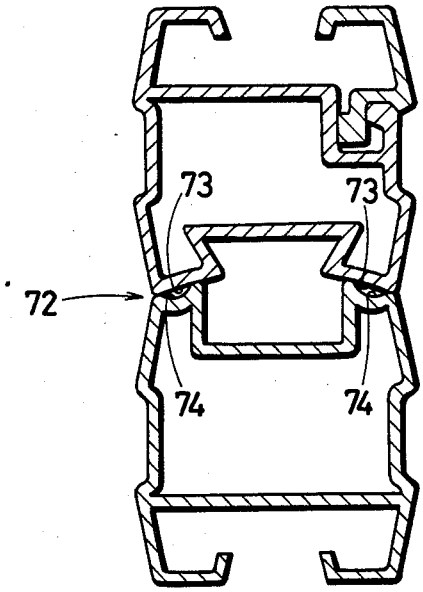
FIG. 23 is a sectional view showing an example of the frame comprising the shutter.

An arrangement to prevent water from coming inside the shutter through the gap (72) between slats is shown in FIG. 23, in which the inside and outside of the butted end of the frame member along the longitudinal direction of the slats is shaped slightly higher toward the inside of the frame at upper side surfaces (73, 73) of the gap (72) between the slats, and the lower side surfaces (74, 74) at gap (72) between the slats come in contact with the upper side surfaces (73, 73) forming the shape of two step projections.

The hinge composition of the shutter by the present invention is provided at both sides of the inner and outer corners on the slat butt end. However, the hinge may be provided at the inside and outside corners in the middle of the slat butt end at one points or more.

In the preferred embodiment, the roller with the long support shaft travels on the outside rail, and the roller with the short support shaft travels on the inside rail. This arrangement, however, may be reversed. It is also possible to feed both large and small rollers on one rail and to drop only the small roller from the notch onto the lower guide.

The inside rail departs from the outside rail near the top of the shutter then goes further to the back of the shutter approximately in parallel to the outside rail, as shown in FIG. 8.

it is also acceptable, however, that one rail departs from the other rail at other point and goes further to the back of the shutter below the other rail.

Referring to FIG. 7, intermediate section between the inside and outside rails shall not necessarily be provided with the partition or the groove as in the embodiment. The inside and outside rails may be on the same plane or may be formed separately.

In the structure where the rails are branched upward and downward near the top of the shutter, a notch is formed on the inside rail. It is also possible, to provide the notch on the outside rail so that the roller of the long support shaft drops through the notch.

Composed as described above, the shutter of the present invention has no significant gap between each slat. Accordingly, the shutter is free from such troubles as allowing rain to come inside the shutter between slats, the risk of fingers being caught between the slats, noise due to the collision of slats. Moreover, smooth folding motion of the slats is ensured.

What is claimed is:

1. A two-way hinged assembly comprising (a) two abutting members, said members rotating about respective axes defined by edges of surfaces along which said members abut thereby permitting the rotation of one of said members in either direction with respect to said other member at said abutting surface until said members interfere with each other;

(b) a pair of pin members connected to end portions of one of said abutting members, said pin members extending substantially parallel to one another and substantially coaxial with said axes; and (c) a female member for receiving said pin members connected to end portions of the second abutting member said female members having a receptacle slot bounded by respective jaw members defining a mouth opening away from said second member, said slot including a pair of oppositely directed, coplanar curved channels extending from said mouth towards said second member, for receiving respective pins of said pair, the curvature of said channels being defined by a common radius, each channel including a closed bottom for receiving a respective pin member for pin member rotation thereagainst upon reltive rotation of said abutting members about said axis coincident with said pin, said jaw members being spaced apart less that the distance between outwardly oppositely facing surfaces of said pins and being spaced from respective bottoms associated with opposite channels a distance sufficient to permit said pin member normally resident within a channel to swing out of said channel and said mouth, free of said female member, upon relative rotation of said abutting members in a direction to swing said pin member away from the bottom of the channel in which it normally resides.

2. Apparatus of claim 1 wherein said pins of said pairs are generally cylindrical and include flats extending at least partially along the lengths thereof, on respective surfaces of said pins facing one another, said channel bottoms are rounded and of diameter only slighter larger than cylindrical diameter of said pins and wherein inboard surfaces of said channels include flat segments separated from said curved outboard surfaces of said channels a distance less than diameter of said cylindrical pins but greater than maximum distance through said pins from said flats to said curved cylindrical surfaces.

3. Apparatus of claim 2, wherein outboard surfaces of said jaws proximate jaw juncture with the remainder of said female member are curved, wherein said jaws include shaft members proximate the tips thereof and extending longitudinally the same direction as said pins; wherein said hinging assembly further comprises a guide member secured to the shutter or abutting member to which said pins are secured and rotatable unitarily with said shutter or abutting member about axes defined by either of said pins rotating in said bottoms of said channels, said guide member including shaped guiding means for slidably successively contacting one of said shaft members and said curved outboard jaw surface during rotation of said shutters or said abutting members with respect to one another, with interference between said shaped guiding means and either said contacted shaft or said curved outboard surface of said jaws preventing lateral separation of said shutters or said abutting members during relative rotation therebetween.

4. Apparatus of claim 1, wherein:

(a) said pin members include cylindrical roller sleeves formed about the exterior of said pins, freely rotatable with respect to said first abutting member, for rotatably contacting said receptacle slot of said female member;

(b) said bottoms of said respective channels are tangentially connected by a smooth, continuously curved surface;

(c) wherein said jaws include shaft members mounted proximate the jaw tips and extending longitudinally towards said abutting member on which said female member is mounted;

(d) wherein said pin means further include camming means associated with said roller pins and located at juncture thereof with said abutting member on which said pins are mounted, fixedly secured to the same abutting member as said pins, for limiting angular rotation of said hinged abutting members with respect to one another only when rotating about said roller pin at which said camming means is mounted by interfering contact with said shaft member connected to said female member jaw bounding the channel in the bottom of which said roller of said pin is rotating, as said abutting members rotate with respect to one another.

5. A system of connected shutters movable along a pair of rails between a first position at which said rails extend vertically and said shutters are stacked one above another to define a planar substantially closed wall structure and a second position at which said shutters are stored one against another with surfaces of adjacent shutters, which surfaces had abutted one another in the first position, being parallel and essentially coplanar with each other at said second position while respective first and second surfaces of adjacent shutters, which had been parallel and coplanar with each other in said first position, respectively face oppositely from each other at said second position, comprising:

(a) a plurality of longitudinally elongated shutters, adjacent shutters having ends substantially abutting each other at said first position along surfaces bounded by pairs of longitudinally elongated edges;

(b) hinge means connecting together adjacent shutters and facilitating relative rotation of said connected shutters with respect to one another in at least one direction, at least alternate ones of said hinge means being located at respective odd or even junctures of adjacent shutters of said assembly being a two-way hinge assembly facilitating relative rotation of the two connected abutting shutters in respective direction about respective axes defined by said parallel longitudinally extending edges of said surface along which said shutters abut, thereby permitting rotation of one of said abutting connected shutters in either direction with respect to said other shutter at said abutting surface, said two-way hinge assemblies comprising:

(i) a pair of pin members, said pin members being connected to a first one of said abutting shutters at opposed edges thereof at said abutting end, said pins being parallel to one another and extending substantially coaxial with a respective axis;

(ii) a female member for receiving said pin members of said pair, fixedly connected to the abutting end of the second abutting shutter, having a receptacle slot bounded by respective jaw members defining a mouth opening away from said second shutter, said slot including a pair of oppositely directed, coplanar curved channels extending from said mouth towards said second abutting shutter for receiving respective pins of said pair, the curvature of said channels being defined by a common radius, said channels including closed bottoms receiving respective pin members for rotation of a pin member thereagainst upon relative rotation of said abutting shutter about said axis coincident with said pin, said jaw members being spaced apart less than the distance between outwardly oppositely facing surfaces of said pins and being spaced from respective bottoms associated with opposite channels sufficiently to permit said pin member normally resident within the associated channel to swing out of said channel and said mouth, free of said female member, upon relative rotation of said abutting shutters in a direction to swing said pin member away from the bottom of the channel in which it normally resides;

(c) pairs of rollers respectively longitudinally extending in either direction from respective shutters proximate said surfaces at which said shutters abut at said first position; and (d) said rails receiving said rollers of said respective roller pairs and including means for displacing those rollers connected to said shutters proximate said surfaces of abutment which are joined by said two-way hinge assemblies from the remaining rollers a distance substantially equal to height of a shutter oriented in said first position, when said shutters are at said second position.

6. Apparatus of claim 5, wherein said rollers extend from said shutters proximate said hinging means, wherein said rails include means for displacing said rollers proximate said two-way hinge assemblies as said shutter assembly travels between said first and second positions from a first roller position defined by said rails and at which said shutters are stacked to define a vertical wall at said first position to a second roller position at which said shutters which were vertically adjacent in said first position have their surfaces, which were outwardly facing at said first position, facingly contacted by corresponding surfaces of adjacent shutters.

7. Apparatus of claim 6, wherein said rails further comprise pairs of inner and outer rails, wherein said rollers proximate said hinging means defined by said two-way hinge assemblies ride in said inner rails and remaining rollers ride in said outer rails, wherein said inner rails include said means displacing said rollers proximate said two-way hinge assemblies as said shutter assembly travels between said first and second positions from a first roller position at which said shutters are stacked to define a vertical wall at said first position to a second roller position at which shutters which were vertically adjacent in said first position have their surfaces, which were outwardly facing at said first position, facingly contacted by corresponding surfaces of adjacent shutters.

8. Apparatus of claim 5, wherein said pins of said pair are generally cylindrical and include flats, extending at least partially along the lengths thereof, on respective surfaces of said pins facing one another, said channel bottoms are rounded and of diameter only slightly larger than cylindrical diameter of said pins and wherein inboard surfaces of said channels include flat segments separated from said curved outboard surfaces of said channels a distance less than diameter of said cylindrical pins but greater than maximum distance through said pins from said flats to said curved cylindrical surfaces, wherein said surfaces at which said shutters abut are stepped so that said axes and said pins are vertically offset from one another and wherein said flats are prependicular to a line connecting said pins.

9. Apparatus of claim 5, wherein:

(a) said pin members include cylindrical roller sleeves formed about the exterior of said pins, freely rotatable with respect to said first shutter, for a rotatably contacting said receptacle slot of said female member;

(b) said bottoms of said respective channels are tangentially connected by a smooth, continuously curved surface;

(c) wherein said jaws include shaft members mounted proximate the jaw tips and extending longitudinally towards said abutting shutter on which said female member is mounted;

(d) wherein said pin means further include camming means associated with said roller pins and located at juncture thereof with said abutting shutter, fixedly secured to the same shutter as said pins, for limiting angular rotation of said hinged abutting shutters with respect to one another only when rotating about said roller pin at which said camming means is mounted by interfering contact with said shaft member connected to said female member jaw bounding the channel in the bottom of which said roller of said pin is rotating, as said abutting shutters rotate with respect to one another.

10. Apparatus of claim 5, wherein the surfaces at which said shutters abut in said first position are configured to prevent horizontal passage of rain therethrough;

wherein said abutting surface of said upper shutter is slightly concave proximate said corners at which the abutting surface joins respective vertically oriented horizontally facing surfaces of said upper shutter and a central portion of said upper shutter abutting surface is generally horizontally recessed from said concave portions and connected thereto via respective angular portions positioned so that distance between inboard extremities of said concave portions is less than horizontal width of said central portions;

wherein said abutting surface of said lower shutter is concave proximate the corners at which said abutting surface joins respective vertically oriented horizontally facing surfaces of said lower shutter, with concavity of said lower shutter surfaces being greater than that of said upper shutter surfaces with said lower shutter contacting said upper shutter along longitudinally extending lines at juncture of their respective concave surfaces with their respective vertically oriented horizontally facing exterior surface and along other longitudinally extending lines at interior termination of said concave portions of said lower shutter surface outboard of juncture of said angular portion and said concave portion of said upper shutter abutting surface;

wherein respective interior terminations of said concave portions of said lower shutter surface are connected by two vertical members having a horizontal member running therebetween;

wherein said vertical members, said horizontal member, said angular member and said central portion define a closed cavity between and interior said abutting shutters and running the longitudinal length thereof.

11. Hinge apparatus for connecting together two objects abutting generally along a line and for facilitating relative rotation therebetween in either direction generally about said line and about either one of a pair of axes on either side of said line until one of said objects interfere with the other comprising:

(a) a base member adaptable for connection with an end portion of a first one of said objects;

(b) a pair of parallel pins mounted on said base member and displaced from one another generally parallel with and on either side of said line, axes of said pins respectively defining said axes about which said pair of objects selectively rotate with respect to one another;

(c) a fitting plate adaptable for connection with an end portion of a second one of said objects; and (d) a receptacle member mounted on said fitting plate for receiving said pair of pins, said receptacle member having a pair of jaws which define a mouth opening therebetween, the distance between inner edges of said jaw members being less than the distance between outwardly oppositely facing surfaces of said pins, said jaws further defining a pair of oppositely directed curved channels which open into said mouth opening, the curvature of said channels being defined by a common radius, each channel having a bottom portion for receiving a respective pin for pin rotation therein upon relative rotation of a selected one of said pins about said axis coincident with said selected pin, thereby permitting an unselected one of said pins normally resident within a channel to swing out of said channel and said mouth opening, upon relative rotation of said selected pin.

* * * * *